US009039157B2

(12) United States Patent
Ogata et al.

(10) Patent No.: US 9,039,157 B2
(45) Date of Patent: May 26, 2015

(54) IMAGE PROCESSING METHOD AND IMAGE PROCESSING APPARATUS

(71) Applicant: CANON KABUSHIKI KAISHA, Tokyo (JP)

(72) Inventors: Takao Ogata, Tokyo (JP); Noboru Kunimine, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/742,576

(22) Filed: Jan. 16, 2013

(65) Prior Publication Data

US 2013/0187971 A1 Jul. 25, 2013

(30) Foreign Application Priority Data

Jan. 20, 2012 (JP) ..... 2012-010044
Dec. 21, 2012 (JP) ..... 2012-279688

(51) Int. Cl.
*B41J 2/17* (2006.01)
*B41J 2/07* (2006.01)
*B41J 2/21* (2006.01)

(52) U.S. Cl.
CPC *B41J 2/07* (2013.01); *B41J 2/2107* (2013.01); *B41J 2/2132* (2013.01)

(58) Field of Classification Search
USPC ..... 347/95, 100, 96, 40–43, 20, 21, 9, 6, 347/14; 106/31.13, 31.27, 31.6
See application file for complete search history.

(56) References Cited

U.S. PATENT DOCUMENTS 5,568,169 A * 10/1996 Dudek et al. ..... 347/43
6,848,777 B2 * 2/2005 Chen et al. ..... 347/100
7,396,098 B2 7/2008 Kanematsu et al.
8,721,021 B2 * 5/2014 Nakajima et al. ..... 347/15

FOREIGN PATENT DOCUMENTS

JP 2002-113850 A 4/2002

OTHER PUBLICATIONS

Machine English Translation of JP 2000-289193.*

* cited by examiner

*Primary Examiner* — Julian Huffman
*Assistant Examiner* — Sharon A Polk
(74) *Attorney, Agent, or Firm* — Fitzpatrick, Cella, Harper & Scinto

(57) ABSTRACT

There are provided an image processing apparatus and an image processing method which can shorten a drying time of inks in an edge region of an image, and can form a sharp image without bleeding of the ink applied onto the edge region into a blank paper. The image processing method generates applying data for forming an image on a print medium by a relative scan between print heads for ejecting a first ink and a second ink having the same color with the first ink and lower in surface tension than the first ink, and the print medium. The image processing method generates first data for applying the first ink to a predetermined region that is adjacent to an edge region of the image and that is included in an inside region inward of the edge region, and generates second data for applying the second ink to the edge region.

19 Claims, 13 Drawing Sheets

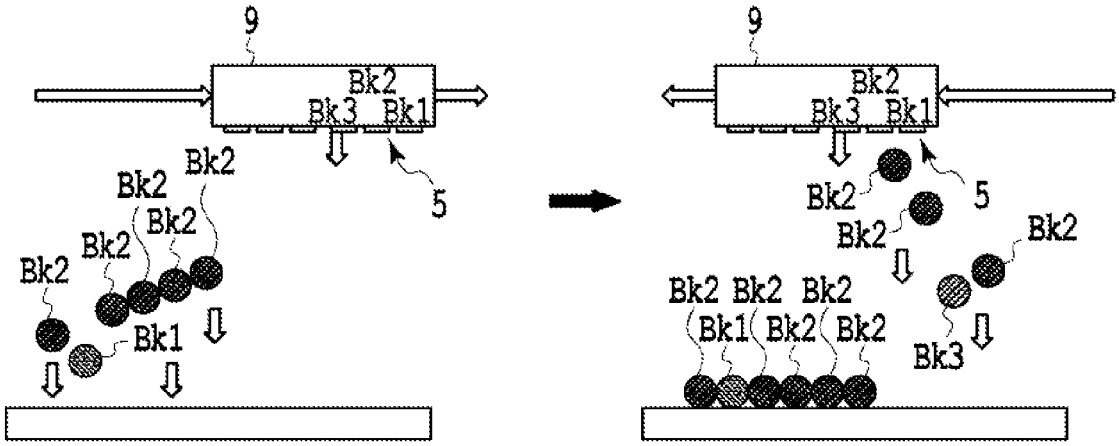
FIG.13A
FIG.13B
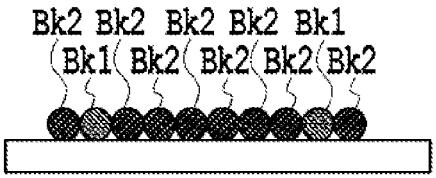
FIG.13C
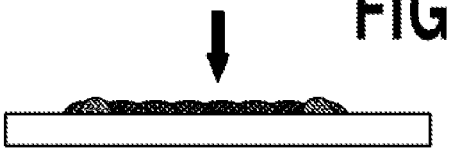
FIG.13D

IMAGE PROCESSING METHOD AND IMAGE PROCESSING APPARATUS

BACKGROUND OF THE INVENTION

1. Field of the Invention

The present invention relates to an image processing method and an image processing apparatus for printing in a predetermined region on a print medium using a plurality of kinds of inks.

2. Description of the Related Art

There are some cases where an inkjet printing apparatus which ejects ink droplets from print heads for printing is adopted as a printing apparatus. Such an inkjet printing apparatus has been widely used in applications such as photos, posters, CAD drawings and the like.

Some of inkjet printing apparatus perform printing in use of a plurality of kinds of inks differing in permeability into a print medium. For example, Japanese Patent Laid-Open No. 2002-113850 discloses such an inkjet printing apparatus.

In the inkjet printing apparatus disclosed in Japanese Patent Laid-Open No. 2002-113850, in regard to an edge region within a region as a print target, printing is performed by a low permeable pigment ink with low permeability into the print medium. In addition, in regard to an inside region surrounded by the edge region within the region as the print target, printing is performed by a combination of the low permeable ink and a high permeable dye ink with high permeability. Since the printing is performed on the edge region portion by the low permeable ink, bleeding of the ink is difficult to be generated on an image, thus making it possible to make a printed image be sharp. In the inside region, the printing is performed by a combination of the low permeable ink which is relatively long in time required for drying and the high permeable ink which is relatively short in time required for drying. Therefore as compared to a case where the printing is performed by the low permeable ink alone, the time required for drying the ink can be made short.

In Japanese Patent Laid-Open No. 2002-113850 as described above, however, the printing is performed in the edge region by using the low permeable ink alone. In a case where the printing is performed by using the low permeable ink alone, the ink having landed on the print medium remains on the print medium without so much permeating the print medium, resultantly taking a relatively long time to dry the ink. Therefore in the printing to the edge region, a drying time of the ink having landed on the print medium becomes long.

SUMMARY OF THE INVENTION

Therefore the present invention is made in view of the foregoing problems, and an object of the present invention is to provide an inkjet processing method and an inkjet processing apparatus which can shorten a drying time of inks in an edge region of an image, and can form a sharp image without bleeding of the ink applied onto the edge region into a blank paper.

According to first aspect of the present invention, there is provided an image processing method for generating applying data for forming an image on a print medium by a relative scan between print heads for ejecting a first ink and a second ink having the same color with the first ink and lower in surface tension than the first ink, and the print medium, the image processing method comprising a step for generating first data for applying the first ink to a predetermined region that is adjacent to an edge region of the image and that is included in an inside region inward of the edge region, and generating second data for applying the second ink to the edge region.

According to second aspect of the present invention, there is provided an image processing method for generating applying data for forming an image on a print medium by a relative scan between print heads for ejecting a first ink and a second ink having the same color with the first ink and higher permeability into the print medium than the first ink, and the print medium, the image processing method comprising a step for generating first data for applying the first ink to a predetermined region that is adjacent to an edge region of the image and that is included in an inside region inward of the edge region, and generating second data for applying the second ink to the edge region.

According to third aspect of the present invention, there is provided an image processing apparatus for generating applying data for forming an image on a print medium by a relative scan between print heads for ejecting a first ink and a second ink having the same color with the first ink and lower in surface tension than the first ink, and the print medium, wherein the image processing apparatus generates first data for applying the first ink to a predetermined region that is adjacent to an edge region of the image and that is included in an inside region inward of the edge region, and generates second data for applying the second ink to the edge region.

According to forth aspect of the present invention, there is provided an image processing apparatus for generating applying data for forming an image on a print medium by a relative scan between print heads for ejecting a first ink and a second ink having the same color with the first ink and higher in permeability into the print medium than the first ink, and the print medium, wherein the image processing apparatus generates first data for applying the first ink to a predetermined region that is adjacent to an edge region of the image and that is included in an inside region inward of the edge region, and generates second data for applying the second ink to the edge region.

According to the present invention, a drying time of the ink in the edge region of the image can be made short, and a sharp-image formation can be made without bleeding of the ink applied onto the edge region into the blank paper.

Further features of the present invention will become apparent from the following description of exemplary embodiments (with reference to the attached drawings).

BRIEF DESCRIPTION OF THE DRAWINGS

FIG. 13A is an explanatory diagram for explaining ink droplets at the time printing is performed while a print head scans in one direction by an inkjet printing apparatus according to the other embodiment;

FIG. 13B is an explanatory diagram for explaining ink droplets at the time printing is performed while the print head scans in the reverse direction to FIG. 13A;

FIG. 13C is an explanatory diagram for explaining ink droplets at the time the ink droplets are ejected from the print head; and FIG. 13D is an explanatory diagram for explaining a state where the ink droplets are mixed on the print medium.

DESCRIPTION OF THE EMBODIMENTS

Hereinafter, embodiments according to the present invention will be explained with reference to the accompanying drawings.

Figure 1:
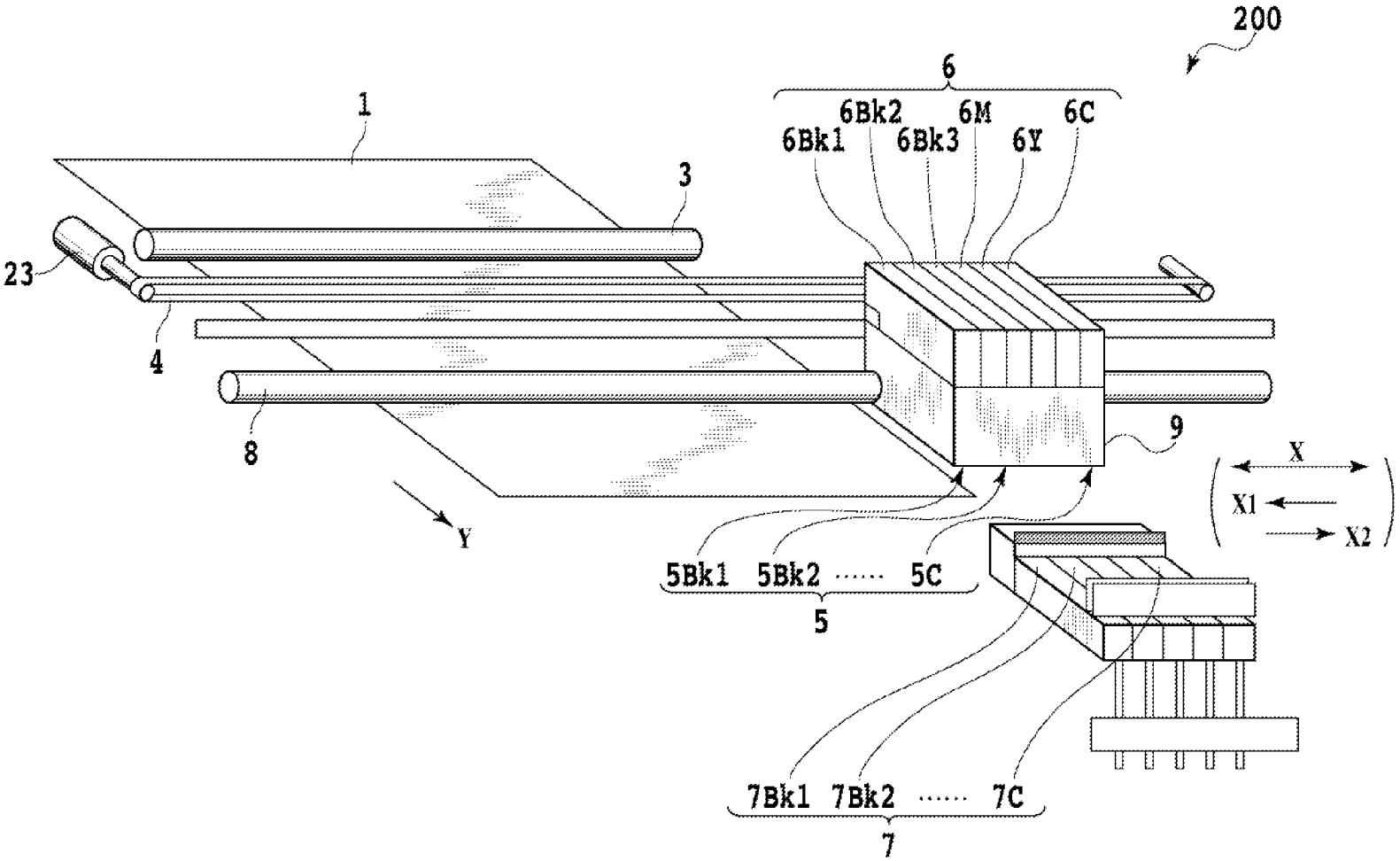
FIG. 1 is a perspective view schematically showing an inkjet printing apparatus according to an embodiment of the present invention.

FIG. 1 is a perspective view schematically showing a main part of an inkjet printing apparatus in the present embodiment. The inkjet printing apparatus 200 is a printing apparatus of a serial scan system, wherein carriage 9 is movably guided in a main scan direction of an arrow A by a guide shaft 8. The carriage 9 can mount print heads 5 thereon. A carriage motor 23 is driven, and the driving force reciprocates the carriage 9 in a main scan direction (X direction) through a driving force transmission mechanism such as a belt 4 or the like. The print heads 5 and ink tanks 6 for supplying inks to the print heads 5 are mounted on the carriage 9. A print medium is conveyed in a sub scan direction of an arrow Y (perpendicular direction in the present embodiment) crossing the main scan direction by a conveying roller 3. The inkjet printing apparatus 200 moves the print heads 5 in the main scan direction, and repeats a print operation for ejecting inks on the print medium and a conveying operation for conveying the print medium in the sub scan direction by a distance corresponding to the print width, thus printing an image on the print medium sequentially. At printing, in this way, the print heads 5 capable of ejecting inks relatively scan the print medium to eject inks in a predetermined region of the print medium for printing an image thereon.

Each of the print heads 5 is provided with a plurality of ejection ports formed therein, which are arranged in a row. Each of the print heads 5 is provided with an ink flow passage formed in such a manner as to be communicated with each of the ejection ports. In the present embodiment, each of the ink flow passages is provided with a heater element (electrothermal transducing element). At the time of ejecting inks from the print heads 5, the heater elements are selectively energized, thus generating thermal energy from the energized heater element. Accordingly, the ink in the ink flow passage is heated for film boiling, and bubbles are generated in the ink in the flow passage, thus ejecting ink droplets from the ejection port by the bubble generating energy.

It should be noted that the print head in the present embodiment is configured as a system which generates film boiling by the heater element for generating bubble, thereby ejecting the ink droplet, however, the present invention is not limited thereto. A print head in the type of transforming a piezo element and thereby ejecting liquids inside the print head may be applied to the printing apparatus in the present invention or a print head in the other type may be applied to the printing apparatus in the present invention.

In the present embodiment, six print heads 5 corresponding to six inks of black 1 (Bk1), black 2 (Bk2), black 3 (Bk3), magenta (M), yellow (Y), and cyan (C) are mounted on the carriage 9. That is, six print heads 5Bk1, 5Bk2, 5Bk3, 5M, 5Y, and 5C respectively ejecting color inks corresponding to six colors are mounted on the carriage 9. 1280 pieces of ejection ports (called also nozzles) are arranged at a density of 1200 dpi in each of the six print heads 5Bk1, 5Bk2, 5Bk3, 5M, 5Y, and 5C. In each of the print heads 5, an ink quantity to be ejected from each ejection port amounts to approximately 4 ng in a single drive of the print head 5.

The inkjet printing apparatus 200 adopts two kinds of inks differing in permeability into the inside of the print medium at the time of landing on the print medium, among inks of the same group color (black ink). An ink (first ink) of black 1 (Bk1) ejected from the print head 5Bk1 has relatively low permeability into the print medium. In the ink of black 1 (Bk1), Bk pigment contained inside the ink is adjusted so that the permeability into the print medium is relatively low.

In addition, an ink (second ink) of black 2 (Bk2) ejected from the print head 5Bk2 has relatively high permeability into the print medium, and has higher permeability than the ink Bk1. In the ink of black 2 (Bk2), Bk pigment is adjusted so that the permeability into the print medium is relatively high.

An ink (third ink) of black 3 (Bk3) ejected from the print head 5Bk3 has relatively low permeability into the print medium, and has lower permeability than the ink Bk2. In the ink of black 3 (Bk3), Bk pigment is adjusted so that the permeability into the print medium is relatively low.

The permeability of inks into the print medium herein means the degree of inks permeating the inside of the print medium at the time of applying the inks onto the print medium. In addition, the permeability of inks into the print medium includes a quantity of inks permeating the print medium per unit time. That is, as the permeability is larger, a quantity of inks permeating the inside of the print medium per unit time becomes the larger. In addition, the permeability of inks into the print medium includes a permeation speed of inks into the inside of the print medium at the time of applying the inks onto the print medium. That is, as the permeability is larger, the ink having landed on the print medium rapidly permeates the side of the print medium. Therefore in this case, the permeation speed of the ink is fast. The permeability changes with surface tension (mN/m) of the ink. As the surface tension of the ink is higher, it takes more time for the ink to permeate the inside of the print medium. Therefore in this case, the permeability of the ink into the print medium is low. In reverse, as the surface tension of the ink is low, the ink relatively easily permeates the inside of the print medium. Therefore in this case, the permeability of the ink into the print medium is high. In the present embodiment, in the high permeable ink which has high permeability into the print medium, the surface tension is in a range from 30 (mN/m) to 37 (mN/m). In addition, in the low permeable ink which has low permeability into the print medium, the surface tension is in a range from 40 (mN/m) to 60 (mN/m). The surface tension was measured by using an automated surface tensiometer CBVP-Z (made by Kyowa Interface Science) after adjusting a temperature of the ink to 25° C.

In addition, six ink tanks 6Bk1, 6Bk2, 6Bk3, 6M, 6Y, and 6C are mounted on the carriage 9 for once reserving inks corresponding to the print heads 5Bk1, 5Bk2, 5Bk3, 5M, 5Y, and 5C respectively. In the present embodiment, the print heads 5 and the ink tanks 6 are configured as a head cartridge in such a manner as to be capable of being integrated or separated, and the head cartridge is configured to be removably mounted on a carriage 9. It should be noted that the print heads 5 and the ink tanks 6 may be separately mounted on the carriage without being configured as the head cartridge.

A cap 7 is provided for capping an ejection port face on which an ejection port is formed for each of the six print heads 5. The six caps 7Bk1, 7Bk2, 7Bk3, 7M, 7Y, and 7C are provided to correspond to colors of inks ejected from the respective print heads 5. The carriage 9 on which the print heads 5 and the ink tanks 6 are mounted is returned back to a home position where the caps 7 are placed, at non-printing. In addition, in a case where a predetermined time elapses since the carriage 9 waits in the home position, a capping operation for making the cap 7 be in contact with the ejection port face of the print head 5 is performed for preventing the ejection port face of the print head 5 from drying. This capping operation can suppress the possibility that the ejection port continues to be exposed to an outside air to increase viscosity of the ink in the periphery of the ejection port for solidification, thus providing an adverse influence on the ejection of the ink.

Figure 2:
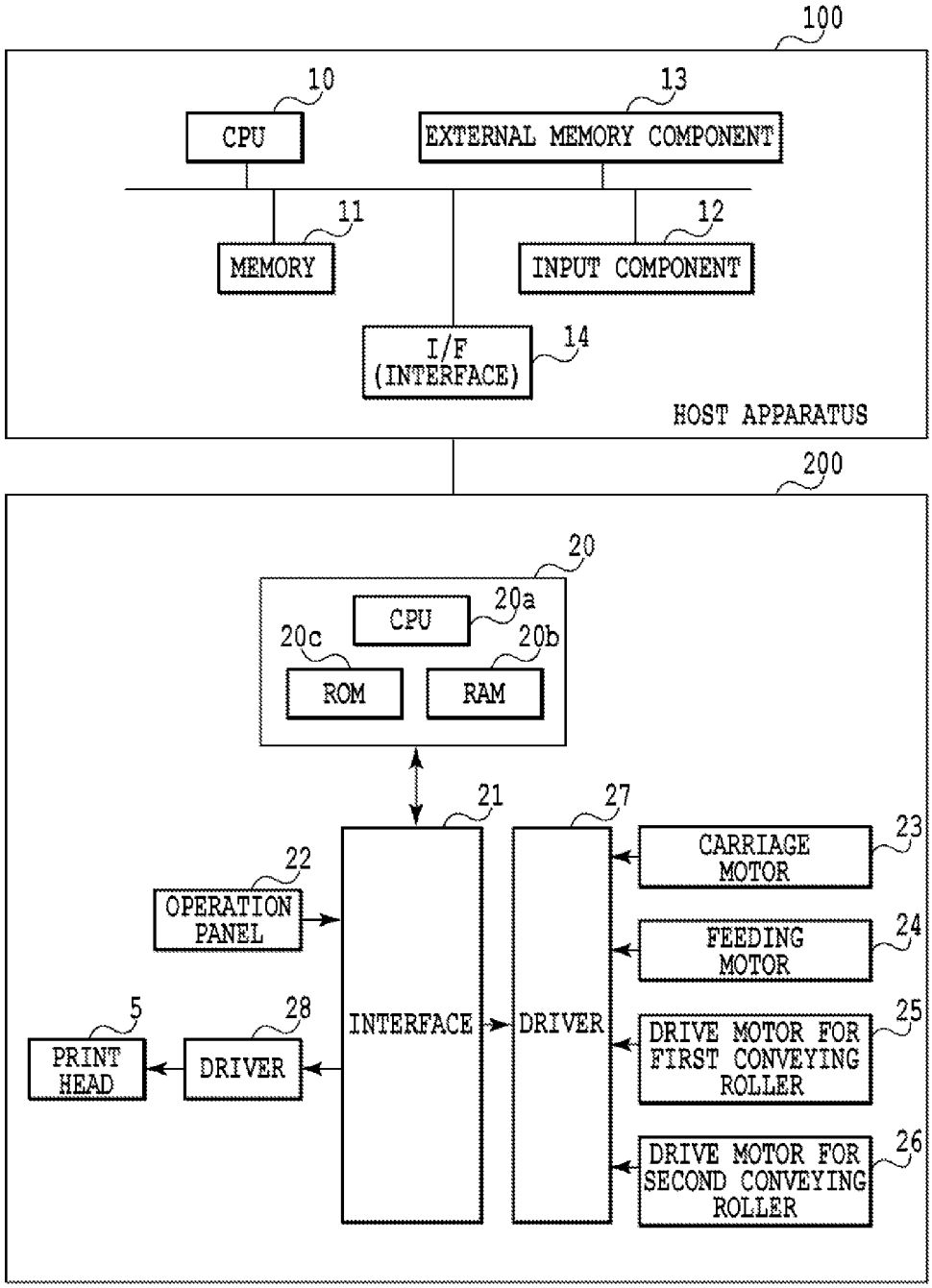
FIG. 2 is a block diagram showing a schematic configuration of a control system for controlling printing by the inkjet printing apparatus in FIG. 1.

FIG. 2 is a block diagram showing the configuration of a printing system including the inkjet printing apparatus 200 according to the present embodiment and a host apparatus 100. The printing system in FIG. 2 is a system including the host apparatus 100 and the inkjet printing apparatus 200. A personal computer or digital camera having a function of an information processing apparatus may be used as the host apparatus 100. The host apparatus 100 is connected to the inkjet printing apparatus (printer) 200, thus making it possible to exchange data therebetween. The host apparatus 100 comprises a CPU 10, a memory 11, an external memory component 13, input components 12 such as a key board, a mouse and the like, and an interface 14 for communications with the printer 200. A user can produce image data to be outputted by the inkjet printing apparatus 200 by executing programs (applications) stored in the memory 11. The CPU 10 performs various kinds of processing according to the programs stored in the memory 11, and performs image processing such as color processing, quantization processing or the like to the image data produced or photographed by a user. The print data subjected to the image processing is sent to the inkjet printing apparatus 200 connected through the interface.

In addition, the inkjet printing apparatus 200 includes a control component 20 which is provided with a CPU 20*a* such as a microprocessor or the like, and a RAM 20*b* used as a work area of the CPU 20*a*, and performing storage or the like of various kinds of data such as print data, registration adjustment values and the like. The control component 20 also includes a ROM 20*c* storing control programs of the CPU 20*a* and various kinds of data. Further, the inkjet printing apparatus 200 includes an interface 21, an operation panel 22, and drivers 27 and 28.

The driver 27 is connected to each of a motor 23 for carriage driving, a motor 24 for feeding roller driving, a motor 25 for first conveying roller pair driving, and a motor 26 for second conveying roller pair driving. The control component 20 performs drive control of the carriage motor 23, the feeding motor 24, the first conveying roller driving motor 25 and the second conveying roller driving motor 26 through the interface 21 and the driver 27. In addition, the driver 28 is connected to the print head 5. The control component 20 performs drive control of the print head 5 through the interface 21 and the driver 28.

The print data, which is sent from the host apparatus 100 and is received through the interface 21 in the inkjet printing apparatus 200, is stored in the RAM 20*b* of the control component 20. The control component 20 outputs ON and OFF signals to the driver 27 for driving the respective motors 23 to 26, and ejection signals and the like to the driver 28 according to the print data stored in the RAM 20*b*. In addition, the control component 20 controls the ink ejection and the movement of the print head 5 to form an image on the print medium.

Next, the composition of the ink applied to the inkjet printing apparatus in the present embodiment will be explained. In the present embodiment, CAB-O-JET300 is used as a black pigment dispersion liquid. The CAB-O-JET300 is a carbon black dispersion liquid having 15% of a carbon black density, and has —COONa as the carbon black hydrophilic group. It should be noted that parts and % in the following description, unless particularly mentioned, are defined on a basis of mass. In addition, the rest means a result of adjustment by ion-exchange water so that a total quantity of the ink amounts to 100 parts.

<Production of Ink Bk2>

The following components are mixed, and the mixture is stirred by a stirrer for one hour, which is filtered by a membrane filter of 1.2 μm to obtain ink Bk2. The surface tension at this time was 32.4 mN/m.

| | |
|---|---|
| Black pigment dispersion liquid | 40.0 parts |
| Glycerin | 7.0 parts |
| Diethylene glycol | 5.0 parts |
| 1,2-Hexanediol | 1.0 parts |
| Acethylenol E 100 (made by Kawaken Fine Chemicals) | 1.0 part |
| Ion-exchange water | the rest |

<Production of Ink Bk1 and Ink Bk3>

Black pigment inks Bk1 and Bk3 were obtained according to the following composition ratio. The surface tension of the obtained pigment ink was 40 mN/m.

| | |
|---|---|
| Black pigment dispersion liquid | 20.0 parts |
| Glycerin | 7.0 parts |
| Diethylene glycol | 5.0 parts |
| 1,2-Hexanediol | 1.0 parts |
| Acethylenol E 100 (made by Kawaken Fine Chemicals) | 0.1 parts |
| Ion-exchange water | the rest |

An example of pigment in a black group includes carbon black such as furnace black, lamp black, acethylene black, channel black and the like. In the present embodiment, CAB-O-JET300 was used, however, commercially available carbon black pigment shown as follows may be used.

Hereinafter, an example of the commercially available carbon black pigment will be shown.

Raven: 7000, 5750, 5250, 5000ULTRA, 3500, 2000, 1500, 1250, 1200, 1190ULTRA-II, 1170, and 1255 (the above-mentioned is made by Columbian Chemicals)

Black pearls L, Regal: 330R, 400R and 660R, Mogul L, Monarch: 700, 800, 880, 900, 1000, 1100, 1300, 1400 and 2000, Vulcan XC-72R, Stirling: MS and NSX 76 (the above-mentioned is made by Cabot).

Color black: FW1, FW2, FW2V, FW18, FW200, S150, S160 and S170, PrintX: 35, 80, 90, 95, U, V, 140U and 140V, Special black: 4, 4A, 5, 6, Nipex, 160IQ, Nipex 170IQ and Nipex 75 (the above-mentioned is made by Evonic).

No. 25, No. 33, No. 40, No. 45, No. 47, No. 52, No. 900, NO. 2200B, No. 2300, MCF-88, MA7, MA8, MA77, MA100 and MA600 (the above-mentioned is made by Mitsubishi Chemical).

It should be noted that the ink composition adopted in the present embodiment shows an example to which the present invention can be applied, and as long as the ink composition is configured of two inks composing of the same group color and differing in permeability, the other combination may be used.

Next, the characteristics of the high permeable ink and the low permeable ink used in the present embodiment will be explained.

According to studies of pigment density, permeability and image performance of the ink used in the present embodiment conducted by the present inventor, the result is made as shown in the following Table 1.

TABLE 1

| | | | | | | |
|---|---|---|---|---|---|---|
| Pig quantity (%) | 4 | 4 | 3 | 3 | 2 | 2 |
| Permeability (surface tension m/Nm) | High | low | high | Low | high | Low |
| Image density | C | A | D | B | D | C |
| Robustness | B | D | B | D | A | C |
| Print quality | D | A | D | A | D | A |

Here, an evaluation of the ink shown in the above Table 1 will be explained. The low permeable ink used in the studies shown in the Table 1 was the ink a pigment density of which was adjusted by adjustment of the quantity of a black pigment dispersion liquid in the above ink Bk1, and the permeability (surface tension) is 40 mN/m. In addition, as the high permeable ink, the ink of which a pigment density is adjusted by adjustment of the quantity of a black pigment dispersion liquid in the above ink Bk2, is used, and the permeability (surface tension) is 32 mN/m.

(Regarding an Evaluation of Robustness (Anti-Marker Properties) of the Ink Droplet Having Landed on a Print Medium)

For the evaluation of the anti-marker properties, the ink, the inkjet printing apparatus and the print medium as explained above are used and black characters of a 10-point gothic form (characters of 「電驚」) are formed on the print medium. At this time, the edge portion was set to form a region corresponding to two pixels from a contour of a printed image adjacent to a non-print region, in which the printing is not performed by the 10-point black character, toward the inside.

The print medium on which the black characters were formed by the above-mentioned operation was left for one minute since it was discharged from the inkjet printing apparatus. Then, the marking was made on the black character portion by a marker (spot writer V (made by Pilot Co.). Thereafter, there was conducted the evaluation on whether or not a trail was generated in a part of the printed image to which the marking was made by the marker. The trailing means a phenomenon that as a result that a marking is made by a marker, an image is cut out by the marker and a part of the printed image is protruded outside of a predetermined region along the movement of the marker. In addition, the state of the trail at this time is visually evaluated using the following evaluation standard. In the present invention, when the evaluation using the following evaluation standard is made as B or better than B, it is determined that the printed image has sufficient anti-marker properties.

A: Generation of the trailing was not confirmed.

B: Generation of the trailing was slightly confirmed.

C: Generation of the trailing was confirmed.

D: Generation of the trailing was remarkable.

(Regarding an Evaluation on Print Quality (Sharpness of Characters)

For the evaluation on the sharpness of characters, the ink, the inkjet printing apparatus and the print medium used for the evaluation on the anti-marker properties are used, and black characters of a 10-point gothic form are formed as similar to the evaluation on the anti-marker properties. In regard to the print medium immediately after discharged, the boundary portion between the black character and a region in which characters on the print medium were not formed was observed using a microscope (made by Keyence). In this way, the sharpness of the character was evaluated. In regard to the sharpness of the character, the degree of a blur of the character was visually evaluated using the following evaluation standard. In the present invention, it was determined that when the evaluation using the following evaluation standard was made as B or better than B, the printed image had a sufficient sharpness of the character.

A: The blur of character was not confirmed.

B: The blur of character was slightly confirmed.

C: The blur of character was confirmed.

D: The remarkable blur of character was confirmed.

(Evaluation on Image Density)

For the evaluation on the image density, the ink, the inkjet printing apparatus and the print medium used in the evaluation on the anti-marker properties and the evaluation on the print quality are used to form a solid image of 2 cm×2 cm. At this time, the solid image was set such that a region corresponding to two pixels, which was adjacent to a non-print region in which printing was not performed and was positioned from a contour of a printed image toward a center thereof, was formed as an edge portion in the solid image. The print medium on which the solid image was formed by the above-mentioned operation was left for 24 hours since it was discharged from the inkjet printing apparatus. Then, the image density of the entire solid image was measured by a reflection density meter X-Rite 500 series (made by X-Rite Co.). The evaluation on the image density obtained by the above operation was made using the following evaluation standard. In the present invention, when the evaluation using the following evaluation standard is made as B or more than B, it is determined that the printed image has a sufficient image density.

A: Image density is equal to or greater than 1.30

B: Image density is from 1.25 to less than 1.30

C: Image density is from 1.10 to less than 1.25

D: Image density is less than 1.10.

As shown in the study result in the Table 1, in a state of maintaining the print quality and robustness of the edge portion to be high, the image density becomes low. Therefore the density of the edge portion in the image is low and the image looks blurred.

Next, an explanation will be made of the degree of permeability of ink droplets into a print medium when the ink droplets land on the print medium to overlap.

Figure 3A:
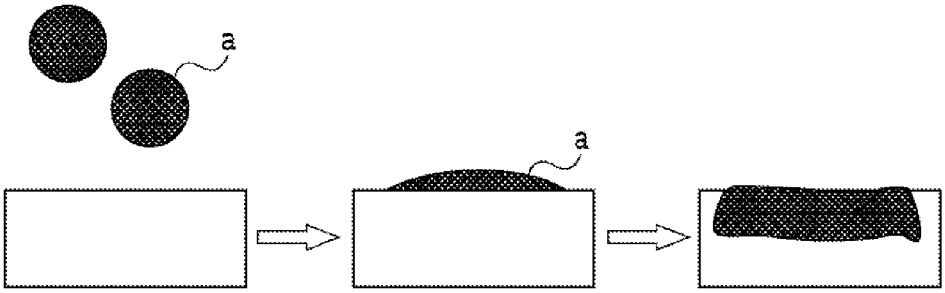
FIG. 3A is cross sectional views each showing a section of a print medium at the time ink droplets permeate the print medium when a plurality of high permeable inks are ejected thereon by the inkjet printing apparatus in FIG. 1.
Figure 3B:
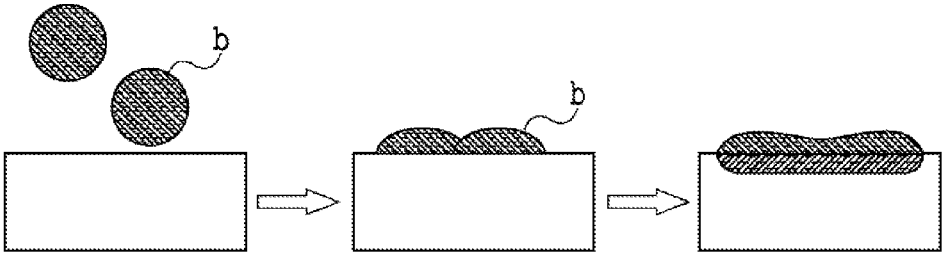
FIG. 3B is cross sectional views each showing a section of the print medium at the time ink droplets permeate the print medium when a plurality of low permeable inks are ejected thereon by the inkjet printing apparatus in FIG. 1.

FIG. 3A and FIG. 3B show cross sections in regard to sections of a print medium in a state where when a plurality of inks each having the same permeability land on a print medium, ink droplets thereof permeate the print medium. FIG. 3A shows a cross section of the print medium when ink droplets by two high permeable inks land on the print medium. As an ink droplet a shown in FIG. 3A, when the ink droplet landing on the print medium is formed of a high permeable ink droplet, the ink does not almost remain on the surface of the print medium, and equally permeates the inside of the print medium. In addition, FIG. 3B shows cross sections of the print medium when ink droplets by two low permeable inks land on the print medium. As an ink droplet b shown in FIG. 3B, when the ink droplet landing on the print medium is formed of a low permeable ink droplet, the permeability of the ink droplet into the print medium is relatively shallow, and apart of the ink remains on the surface layer of the print medium.

Next, in a case where two kinds of inks differing in permeability into a print medium are applied onto the print medium plural times, an explanation will be made of the degree of permeability of the ink droplets into the print medium.

Figure 4:
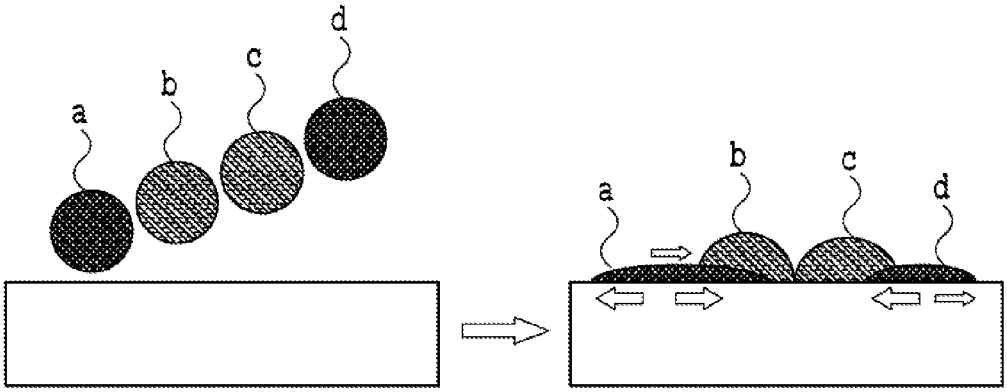
FIG. 4 is cross sectional views each showing a section of a print medium in a state where two kinds of ink droplets differing in permeability are applied onto the print medium every two droplets by the inkjet printing apparatus in FIG. 1 and the ink droplet permeates the print medium.

In the present embodiment, ink droplets b and c of two inks having low permeable characteristics are positioned between ink droplets a and d of two inks having high permeable characteristics, and land on a print medium to be interposed therebetween. FIG. 4 shows cross sections in regard to each ink droplet and the print medium. In addition, FIG. 5 shows cross sections in regard to ink droplets and sections of the print medium in a state where when the high permeable ink a and the low permeable ink b already land on the print medium, the low permeable ink c is applied onto the high permeable ink a and the high permeable ink d is applied onto the low permeable ink b.

When the high permeable inks a and d, and the low permeable ink b and c thus land on the print medium, the following is found out based upon the permeability and the landing-on order. When the low permeable ink lands on the print medium ahead of the high permeable ink, the high permeable ink applied later tends to more easily flow into the low permeable ink than into the print medium.

Figure 5:
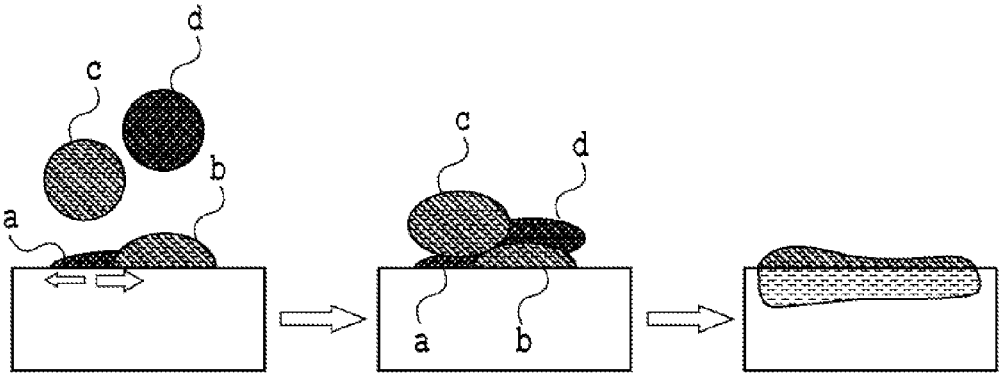
FIG. 5 is cross sectional views each showing a section of a print medium in a case where a low permeable ink and a high permeable ink are in advance applied one by one by the inkjet printing apparatus in FIG. 1, then a high permeable ink is applied onto the low permeable ink, and a low permeable ink is applied onto the high permeable ink.

In addition, as shown in FIG. 5, the low permeable ink b and the high permeable ink a are sequentially applied onto the first layer, thereafter the high permeable ink d is applied onto the low permeable ink b, and the low permeable ink c is applied onto the high permeable ink a on the second layer to perform printing. As a result, the permeability of the ink droplet a having the high permeability into the print medium is relatively suppressed as compared to a case of printing by the high permeable ink only, it is found out that the bleeding by the high permeable ink can be reduced to suppress deterioration of the print quality. In addition, as compared to a case of printing by the low permeable ink only, a quantity of the inks permeating the inside of the print medium increases and the image density or the robustness of the inks having landed on the print medium improves, and therefore it is found out that the evaluation is excellent. At this time, in a case where the low permeable ink was first applied and thereafter the high permeable ink was applied, the evaluation was good in a case where an applying quantity of the high permeable ink to be applied later was set to 0.2 times to 1.0 time an applying quantity of the low permeable ink to be applied ahead.

Table 2 shows the result of the evaluation in the evaluation method similar to that in the evaluation to the above Table 1.

TABLE 2

| | | | |
|---|---|---|---|
| Presence/absence of first application of high permeable ink | Absence | absence | Presence |
| Pig quantity (%) | 2 | 2 | 2 |
| Permeability (surface tension mN/m | High | Low | Low |
| Image density | D | C | B |
| Robustness | A | C | B |
| Print quality | D | A | B |

Figure 6:
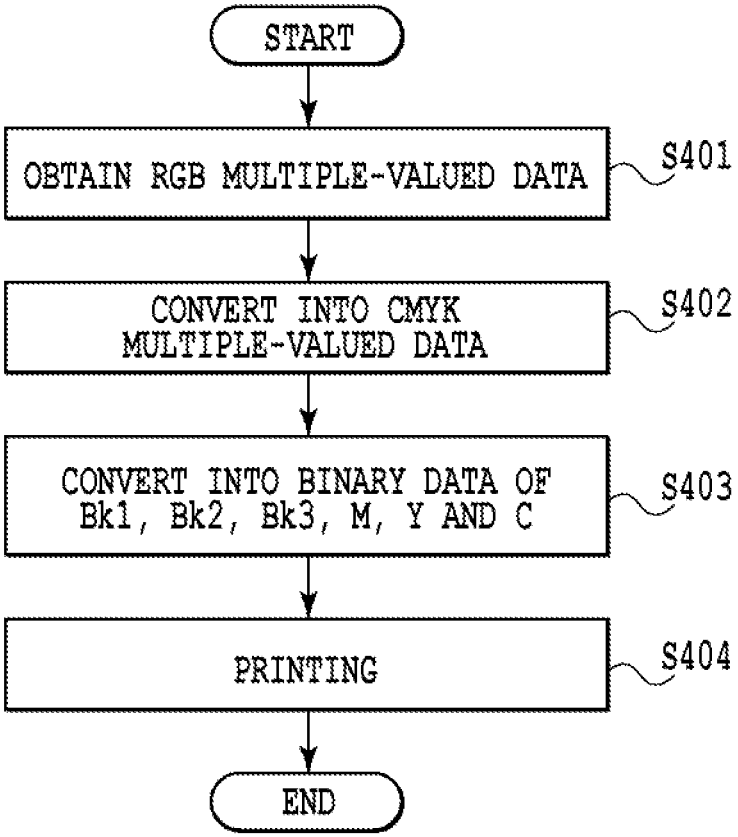
FIG. 6 is a flow chart showing a flow of printing control at the time of performing printing by the inkjet printing apparatus in FIG. 1.

FIG. 6 shows a flow chart for control of the processing at printing according to the present embodiment. When a user sends a print instruction of image data, a printer driver installed in the host apparatus 100 obtains RGB multiple-valued data of the image data (S401). Next, the printer driver converts the RGB multiple-valued data produced in a RGB color space into CMYK multiple-valued data in the CMYK color space corresponding to inks used for printing (S402). Further, the CMYK multiple-valued data is converted into binary data corresponding to each ink of Bk1, Bk2, Bk3, M, Y and C (S403).

The inkjet printing apparatus 200 performs printing based upon the binary data received from the host apparatus 100 (S404). At this time, in a case of multi-path printing of completing an image by performing a plurality of times of print scans to the same region of the print medium, the inkjet printing apparatus 200 distributes the binary data to printing of each scan in such a manner as to print the image with the binary data in S403 by performing the plurality of times of the print scans. The distribution of the data to each scan at this time is performed using a mask stored in the ROM 20*c*. Inks are ejected in each print scan based upon the distributed data to form the image on the print medium.

Figure 7:
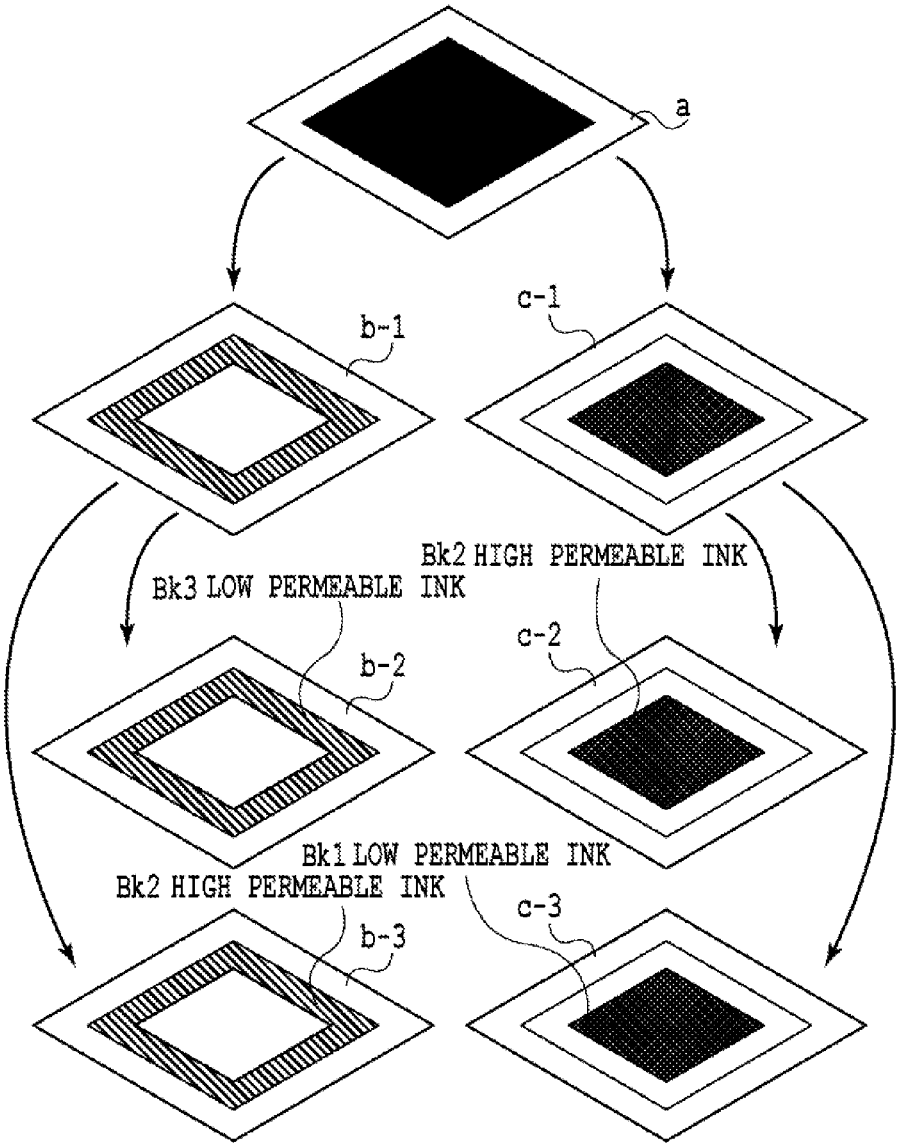
FIG. 7 is explanatory diagrams for explaining a distribution of print data to respective print heads from original print data at the time of performing printing by the inkjet printing apparatus in FIG. 1.

Next, the distribution of the print data in the present embodiment will be explained. FIG. 7 shows an explanatory diagram for explaining the distribution of the print data for each print head in the present embodiment.

First, input print data a is dissolved into edge portion print data b-1 corresponding to print data of an edge portion in a print region and non-edge portion print data c-1 corresponding to print data of a non-edge portion (inside region) in the print region.

For distributing the print data from the entire print data to each layer, the order of 1 to 10 pixels is detected as print data of the edge portion in the original image from an end of the print data in the original image. When the edge portion of the print data in the original image is detected, an image of a portion other than the edge portion among the print data in the original image is defined as print data of the non-edge portion.

In addition, the edge portion print data and the non-edge portion print data are respectively distributed into print data applied by the low permeable ink and print data applied by the high permeable ink. In this way, the print data to each region is dissolved into image data of the ink actually used by each of the print heads 5.

As shown in FIG. 7, the edge portion print data b-1 is dissolved into print data b-3 applied by the high permeable ink Bk2 and print data b-2 applied by the low permeable ink Bk3. In addition, the non-edge portion print data c-1 is dissolved into print data c-3 applied by the low permeable ink Bk1 and print data c-2 applied by the high permeable ink Bk2.

In regard to the print data in the image layer of the non-edge portion c-3, the ink ejection is thus performed by the print head 5Bk1 ejecting the low permeable ink Bk1. In addition, in regard to the print data in the image layers of the edge portion b-3 and the non-edge portion c-2, the ink ejection is performed by the print head 5Bk2 ejecting the high permeable ink Bk2. In addition, in regard to the print data in the image layer of the edge portion b-2, the ink ejection is performed by the print head 5Bk3 ejecting the low permeable ink Bk3.

The entire print data a inputted is thus distributed into the three print heads 5. Each of the print heads 5 performs an ink ejection of the distributed print data for printing.

FIGS. 8A, 8B, 8C and 8D are explanatory diagrams for explaining the ink ejection at the time the ink ejection of the print data distributed to each of the print heads 5 is performed on the print medium. First, the ink is ejected from an ejection port of the print head 5Bk1 positioned in the head along the main scan direction in which the print heads 5 move, and thereafter the ejection of the ink is sequentially performed in order of the print head 5Bk2 and the print head 5Bk3. At this time, the ink ejection is performed from each of the print heads 5 based upon the print data distributed to each of the print heads 5.

As shown in FIGS. 8A, 8B, 8C and 8D, first, the ejection of the ink is performed to the non-edge portion in the print region from the ejection port of the print head 5Bk1 ejecting the low permeable ink. At this time, the ink ejection is performed in regard to the print data corresponding to the image layer c-3 shown in FIG. 7. Next, the ejection of the ink is performed onto the edge portion and the non-edge portion in the print region (entirety of the print region) from the ejection port of the print head 5Bk2 ejecting the high permeable ink. At this time, the ink ejection is performed in regard to the print data corresponding to integration of the image layers c-2 and b-3 shown in FIG. 7. Next, the ejection of the ink is performed onto the edge portion in the print region from the ejection port of the print head 5Bk3 ejecting the low permeable ink. At this time, the ink ejection is performed in regard to the print data corresponding to the image layer b-2.

In this way, according to the present embodiment, the printing is performed to the edge portion in the print region by using the high permeable ink Bk2. Specifically the high permeable ink Bk2 first lands on the print medium, and thereafter the low permeable ink Bk3 lands on the print medium. In addition, the printing is performed to the non-edge portion in the print region by using the low permeable ink Bk1. Specifically the low permeable ink Bk1 first lands on the print medium, and thereafter the high permeable ink Bk2 lands on the print medium.

Figure 8A:
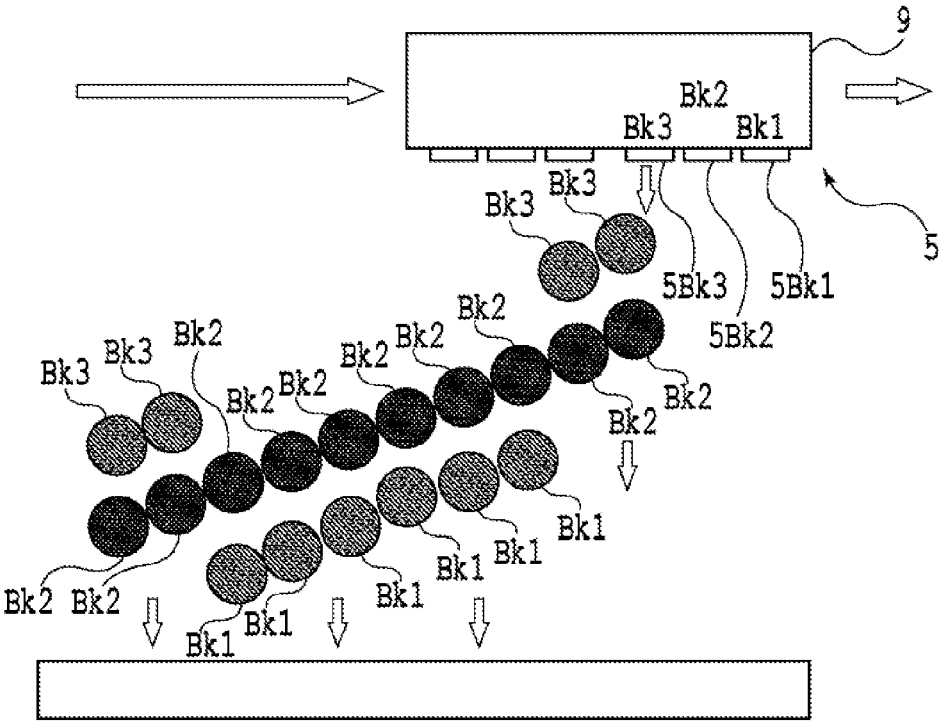
FIG. 8A is an explanatory diagram for explaining ink droplets ejected from respective print heads at the time of performing printing by the inkjet printing apparatus in FIG. 1.
Figure 8B:
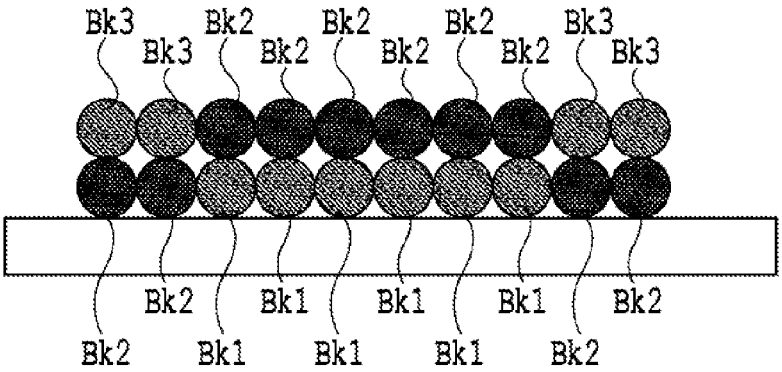
FIG. 8B is a cross sectional view showing the ink droplets ejected on the print medium.
Figure 8C:
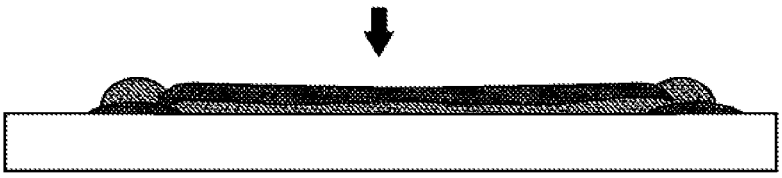
FIG. 8C is a cross sectional view showing the ink droplets ejected and mixed on the print medium.
Figure 8D:
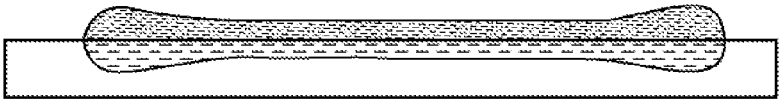
FIG. 8D is a cross section showing the ink droplets having permeated the print medium.

Accordingly ink droplets of the high permeable ink are applied onto the edge portion ahead of those by the low permeable ink. At this time, as shown in FIG. 8B, the low permeable ink is applied onto the non-edge portion to be adjacent to the applied high permeable ink. As a result, the high permeable ink first applied onto the edge portion flows into the low permeable ink adjacent thereto to suppress the permeation of the high permeable ink into the print medium to be small. Therefore the bleeding by the high permeable ink in the edge portion can be suppressed to be small.

Further, after the high permeable ink is applied onto the print medium, the low permeable ink is applied onto the high permeable ink. At this time, the applied low permeable ink, since the high permeable ink is applied ahead, permeates relatively more deeply the inside of the print medium as compared to a case where the low permeable ink only is applied. Therefore the ink is fixed onto the print medium in a state where relatively more low permeable inks permeate the inside of the print medium as compared to a case where the low permeable ink only is applied. Therefore the fixing property of the ink applied onto the print medium can be improved in the edge portion. In addition, the robustness and the anti-marker properties of the ink droplet applied onto the print medium can be improved. Further, since the low permeable ink is applied onto the edge portion after the high permeable ink is applied thereon, many ink droplets can remain on the surface of the print medium to hold an output image in the edge portion to be sharp.

On the non-edge portion, the low permeable ink first lands, and thereafter the high permeable ink lands thereon. Since the low permeable ink is first printed across the entire non-edge portion, the high permeable ink to be applied thereafter results in mixing with the low permeable ink before permeating the print medium. Therefore the permeation of the ink into the inside of the print medium can be suppressed to be smaller as compared to a case where the high permeable ink only is applied. Therefore the relatively many inks having landed on the non-edge portion remain on the print medium, the density of the printed image printed on the non-edge portion is held to be high, and the quality of the printed image is maintained to be high. In addition, since the high permeable ink is applied on the non-edge portion after the low permeable ink is applied thereon, many inks permeate the inside of the print medium to maintain the robustness and the anti-marker properties of the printed image to be high.

In this way, the high permeable ink and the low permeable ink are mixed at the time of applying them on the print medium and a balance between the high permeable ink and the low permeable ink is adjusted, thus making it possible to adjust the degree of the permeation.

A region in the print medium, which is outside of the print region and in which printing is not performed because of no landing-on of the ink, is defined as a non-print region. At this time, on the edge portion which is in a predetermined print region where printing is performed and adjacent to the non-print region where printing is not performed, the high permeable ink is first applied on the print medium. Thereafter the low permeable ink is applied on the edge portion in the predetermined print region. In addition, on the non-edge portion which is in the predetermined print region, adjacent to the edge portion, and positioned inside of the edge portion, the low permeable ink is first applied on the print medium. Thereafter the high permeable ink is applied on the non-edge portion in the predetermined print region. In the present embodiment, the ejection of the ink from the print head 5 is thus controlled. In the present embodiment, a control component 20 in the inkjet printing apparatus 200 acts as a print controlling unit for controlling the ejection of the ink from the print head 5. It should be noted that in the present embodiment, the control component 20 in the inkjet printing apparatus 200 acts as the print controlling unit, however the present invention is not limited thereto. The CPU 10 in the host apparatus 100 may act as the print controlling unit.

Here, an explanation will be made of the printing in a case where the low permeable ink only is applied on the edge portion, and the high permeable ink is applied on the non-edge portion after the low permeable ink is applied thereon, as a comparative example.

Figure 9A:
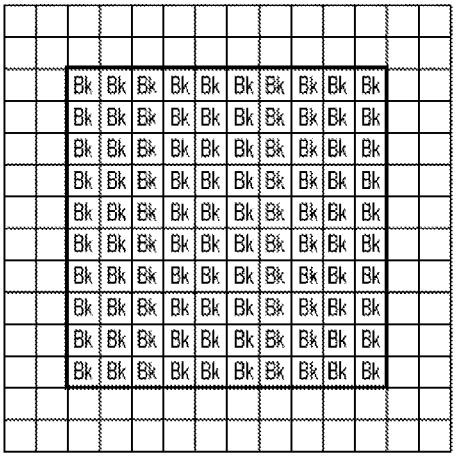
FIG. 9A is an explanatory diagram for explaining original print data at the time of performing printing by an inkjet printing apparatus according to a comparative example.
Figure 9B:
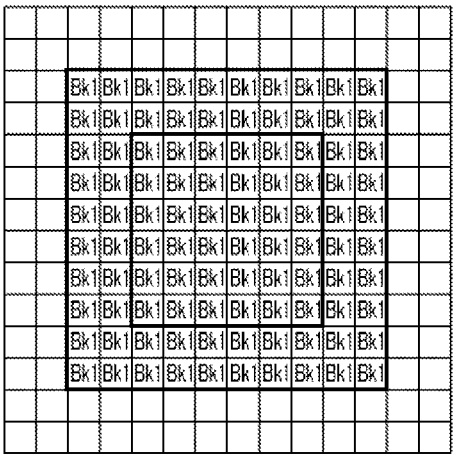
FIG. 9B is an explanatory diagram for explaining print data distributed for ejecting low permeable inks from the original print data according to the comparative example.
Figure 9C:
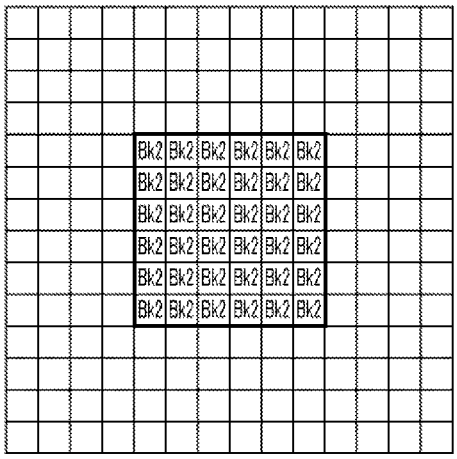
FIG. 9C is an explanatory diagram for explaining print data distributed to high permeable inks from the original print data according to the comparative example.
Figure 10:
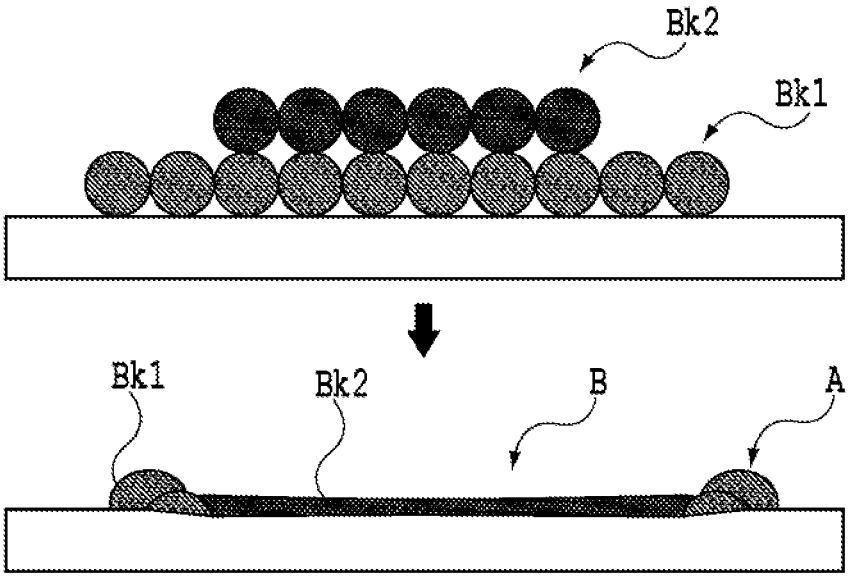
FIG. 10 is explanatory diagrams for explaining permeation of ink droplets ejected from respective print heads into a print medium at the time of performing printing by the inkjet printing apparatus according to the comparative example.

FIG. 9A shows input print data to be printed on the print medium at this time. FIG. 9B shows print data distributed in the low permeable inks Bk1 from the input print data. FIG. 9C shows print data distributed in the high permeable inks Bk2 from the input print data. FIG. 10 shows schematic cross sections of inks and a print medium at the time of printing each ink on the print medium using the print data in FIGS. 9A to 9C.

As shown in FIG. 10, in the printing on the non-edge portion, the low permeable inks Bk1 are first applied, and thereafter, the high permeable inks Bk2 are applied. Therefore on the non-edge portion, the low permeable ink applied first and the high permeable ink applied later are mixed, and the mixed ink will permeate the inside of the print medium. As a result, the permeation becomes shallower as compared to that when the high permeable ink only is printed on the print medium, and pigment in the ink remains near the surface layer. Therefore on the non-edge portion, a constant image density can be held in the printed image, and the robustness of the printed image can be maintained. However, the low permeable ink only is printed in the edge portion (A part in FIG. 10). Therefore the ink having landed on the print medium does not so much permeate the inside of the print medium, and many pigment layers resultantly remain on the surface of the print medium. Accordingly a relatively large part of inks among the inks having landed on the print medium remain on the surface of the print medium, and dry thereon as it is.

For fixing the printed image on the print medium, it is required to dry the ink having remained on the print medium without so much permeating the inside of the print medium for solidification. Accordingly in a case where many ink droplets remain on the print medium, it takes much time to dry the ink droplets. In addition, when fingers or the like of a user makes contact with a portion of the print medium on which the printed image is formed by the low permeable ink only, there is a possibility that the ink protruding on the print medium is removed by the finger or the like. Therefore there is a possibility that the robustness of the printed image is deteriorated. In a case where the ink droplets having landed on the print medium are partly separated or removed, the quality of the printed image is deteriorated due to the separation or the removal.

In contrast, in the printing according to the present embodiment, on the edge portion, the low permeable ink is applied after the high permeable ink is applied. As a result, the low permeable ink applied on the edge portion permeates the inside of the print medium after mixed with the high permeable ink. Therefore relatively more inks permeate the inside of the print medium as compared to a case where the printing is performed by the low permeable ink only. Therefore the quantity of inks remaining on the print medium can be reduced to be small to shorten time required for drying the inks. Therefore the time required for fixing the printed image can be made short. In addition, since a relatively great deal of inks can permeate the inside of the print medium, it is possible to maintain the robustness of the printed image to be high.

In a case where the printing is performed as in the case of the present embodiment, it is preferable that the inkjet printing apparatus 200 includes the print head 5Bk1 ejecting the low permeable ink, the print head 5Bk2 ejecting the high permeable ink, and the print head 5Bk3 ejecting the low permeable ink. In addition, it is preferable that the print head 5Bk2 (second ejection port row) is arranged between the print head 5Bk1 (first ejection port row) and the print head 5Bk3 (third ejection port row) along a scan direction in which the print head 5 scans. In this case, the printing in a predetermined print region can be performed by a single scan. In this case, in the same scan by the print head 5, the printing on the non-edge portion is resultantly completed ahead of that on the edge portion.

That is, it is preferable that as the configuration of the inkjet printing apparatus for adopting the print method in which the high permeable ink is applied on the low permeable ink of the same color group, the print heads for ejecting inks differing in permeation speeds are respectively provided to be alternately arranged. In the present embodiment, the print head 5Bk1 and the print head 5Bk3 each ejecting the low permeable ink are arranged upstream and downstream of the print head 5Bk2 along the main scan direction of the print head to interpose the print head 5Bk2 ejecting the high permeable ink therebetween. When the respective print heads 5 are thus arranged, the printing by the high permeable ink and the printing by the low permeable ink can be performed in the above order by a single scan of the print head 5. In a case where the printed image is printed by a plurality of times of scans and the printing is performed not only in the forward path but also in the backward path, ink ejected from the print head 5Bk3 is set to eject the upstream low permeable ink and ink ejected from the print head 5Bk1 is set to eject the downstream low permeable ink, thus making it possible to perform the printing as similar to that in the above printing method.

It is desirable that each distance in the main scan direction between the ejection port rows in the print heads 5 composed of the print heads 5Bk1, 5Bk2 and 5Bk3 is set to be sufficiently long. This structure enables the low permeable ink Bk1 to certainly land on the non-edge portion ahead of the high permeable ink Bk2. In addition, this structure enables the high permeable ink Bk2 to certainly land on the edge portion ahead of the low permeable ink Bk3.

With respect to printed images of three or more pixels, dissolution processing of the edge portion and the non-edge portion is performed, and layers to which the respective print data is distributed are produced. Thereby it is possible to perform the printing maintaining a balance between the image density, the robustness and the image quality. In regard to printed images of two pixels, as explained using FIG. 5, one pixel is processed as the edge portion, and the other pixel is processed as the non-edge portion, and thereby it is possible to perform the printing maintaining a balance between the image density, the robustness and the image quality as similar to the images of three or more pixels.

It should be noted that in the present embodiment, an explanation is made by taking an embodiment where the high permeable ink is applied on the edge portion, and thereafter the low permeable ink is applied thereon, as an example. However, the low permeable ink may be not necessarily applied on the edge portion. On the edge portion the printing may be performed by the high permeable ink only. In a case where the high permeable ink only is applied on the edge portion, the high permeable ink applied on the edge portion makes contact with the low permeable ink applied on the non-edge portion. Therefore the bleeding of the edge portion by the high permeable ink on the edge portion can be suppressed. In a case where the printing is performed by applying only the high permeable ink on the edge portion, the bleeding of the edge portion can be adjusted by adjusting an applying quantity of the low permeable ink to be applied on the non-edge portion. For example, when an applying quantity of the low permeable ink is set to be equal to or more than an applying quantity of the high permeable ink, the bleeding of the edge portion can be suppressed. As a result, a sharp image can be obtained by printing.

In addition, only with the aim at suppressing the bleeding on the edge portion, on the non-edge portion, the low permeable ink is only required to be applied to make contact with the high permeable ink applied on the edge portion. Therefore it is not necessary to apply the low permeable ink in an entire region of the non-edge portion. That is, the low permeable ink is only required to be applied in a region adjacent to the edge portion in the non-edge portion, specifically in a region having a width corresponding to several pixels (for example, the order of three to six pixels) in the non-edge portion. In this case, any ink of the low permeable ink and the high permeable ink may be used in the other region of the non-edge portion. Further, in the present embodiment, the high permeable ink is applied on the non-edge portion after the low permeable ink is applied thereon for reducing the drying time, however, in the present invention, the high permeable ink may be not necessarily applied on the non-edge portion. In addition, by setting the applying quantity of the high permeable ink to be equal to or more than that of the low permeable ink on the non-edge portion, the drying time of the non-edge portion can be reduced.

Immediately after the low permeable ink lands on the medium, that is, in a state when the low permeable ink does not yet sufficiently permeate the inside of the print medium, in a case where the printing is performed in such a manner that the aforementioned high permeable ink overlaps the low permeable ink, the low permeable ink and the high permeable ink are first mixed on the print medium. Thereafter, the ink in a state where the low permeable ink and the high permeable ink are mixed permeates the inside of the print medium, thus making it possible for the ink to rapidly permeate the inside of the print medium.

It should be noted that in the present embodiment, two different kinds of inks differing in permeability into the print medium, which comprise the low permeable ink and the high permeable ink, are used, however, the present invention is not limited thereto. If a plurality of kinds of inks differing in permeability are used, three or more different kinds of inks differing in permeability into the print medium may be used. In this case, if the ink having relatively high permeability into the print medium and the ink having relatively low permeability into the print medium are used as the plurality of kinds of inks, the print control as in the case of the present embodiment may be performed.

In addition, in the above embodiment, the ink in use is composed of a plurality of kinds of black inks differing in permeability, however, the present invention is not limited thereto. If a plurality of kinds of inks in the same group color and differing in permeability are used, the present invention may be applied to the ink of the other color.

It should be noted that in the present specification, "printing" is used not only in a case of forming significant information such as characters, graphics and the like but also is used regardless of significance or insignificance. In addition, "printing" is defined to, regardless of it becomes obvious for man to be capable of being visually perceived, widely express also a case of forming images, designs, patterns and the like on a print medium or processing the print medium.

Further, "printing apparatus" includes an apparatus having a print function, such as a printer, a printer complex machine, a copier, a facsimile machine and the like, and a manufacturing apparatus for manufacturing goods using an inkjet technique.

In addition, "print medium" is defined to widely express not only a paper used in a general printer, but also a medium capable of receiving inks, such as cloth, plastics, films, metallic plates, glass, ceramic, lumber, leather and the like.

Further, "ink" (called "liquid" case by case) should be widely interpreted as similar to the definition of the above "printing". "ink" is defined to express a liquid which is applied on a print medium to be supplied to formation of images, designs, patterns and the like or processing of a print medium, or processing of inks (for example, solidification or insolubilization of coloring materials in inks applied on a print medium).

Other Embodiments

With reference to FIG. 11 to FIG. 13A-13D, the other embodiments in the present invention will be explained. Here, an explanation will be made of an embodiment using vinyl chloride of non-absorption medium as a print medium. A print medium having no ink receiving layer in the print medium, such as vinyl chloride or the like, which differs from the print medium for regular inkjet, can not absorb inks. In most of the cases, a method for fixing an image, having landed on and having been formed on a print medium, on the print medium by a heater is generally used. In the present embodiment, inks of low surface tension, surface tension of which is relatively low and which tend to easily spread on a medium, are used. In regard to the inks used in the present embodiment, even if the ink is an ink of low surface tension, there are two types of inks among it, that is, one is an ink having relatively high surface tension, and the other is an ink having relatively low surface tension. Herein the ink having relatively high surface tension is called a high surface tension ink, and the ink having relatively low surface tension is called a low surface tension ink. The surface tension of the low surface tension ink was 20 mN/m, and the surface tension of the high surface tension ink was 25 mN/m. The surface tensions of these inks were measured using an automated surface tensiometer CBVP-Z (made by Kyowa Interface Science).

Figure 11:
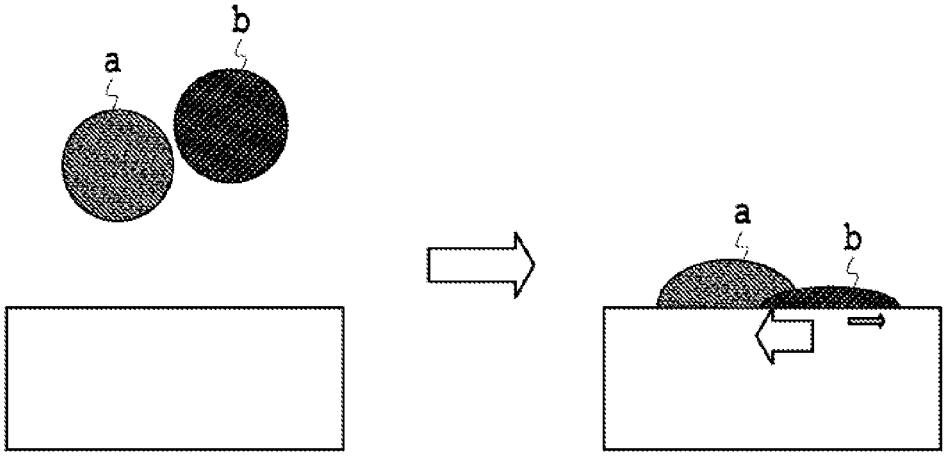
FIG. 11 is schematic diagrams showing a behavior of ink droplets on a non-absorption print medium in another embodiment.

FIG. 11 shows behaviors of inks when ink droplets land on the vinyl chloride. In the FIG. 11, droplet a is an ink having low permeability and high surface tension, and droplet b is an ink having high permeability and low surface tension. In a case where the ink droplet a lands on a medium and then the ink droplet b lands thereon to make contact therewith, the liquid droplet moves from the ink having the low surface tension to the ink having the high surface tension to keep the equilibrium of the surface tension. A magnitude of this movement force is shown by a size of an arrow in the figure. Therefore, rather than spreading on a surface portion of the medium having no ink, the ink droplet b flows into the ink droplet a.

Figure 12:
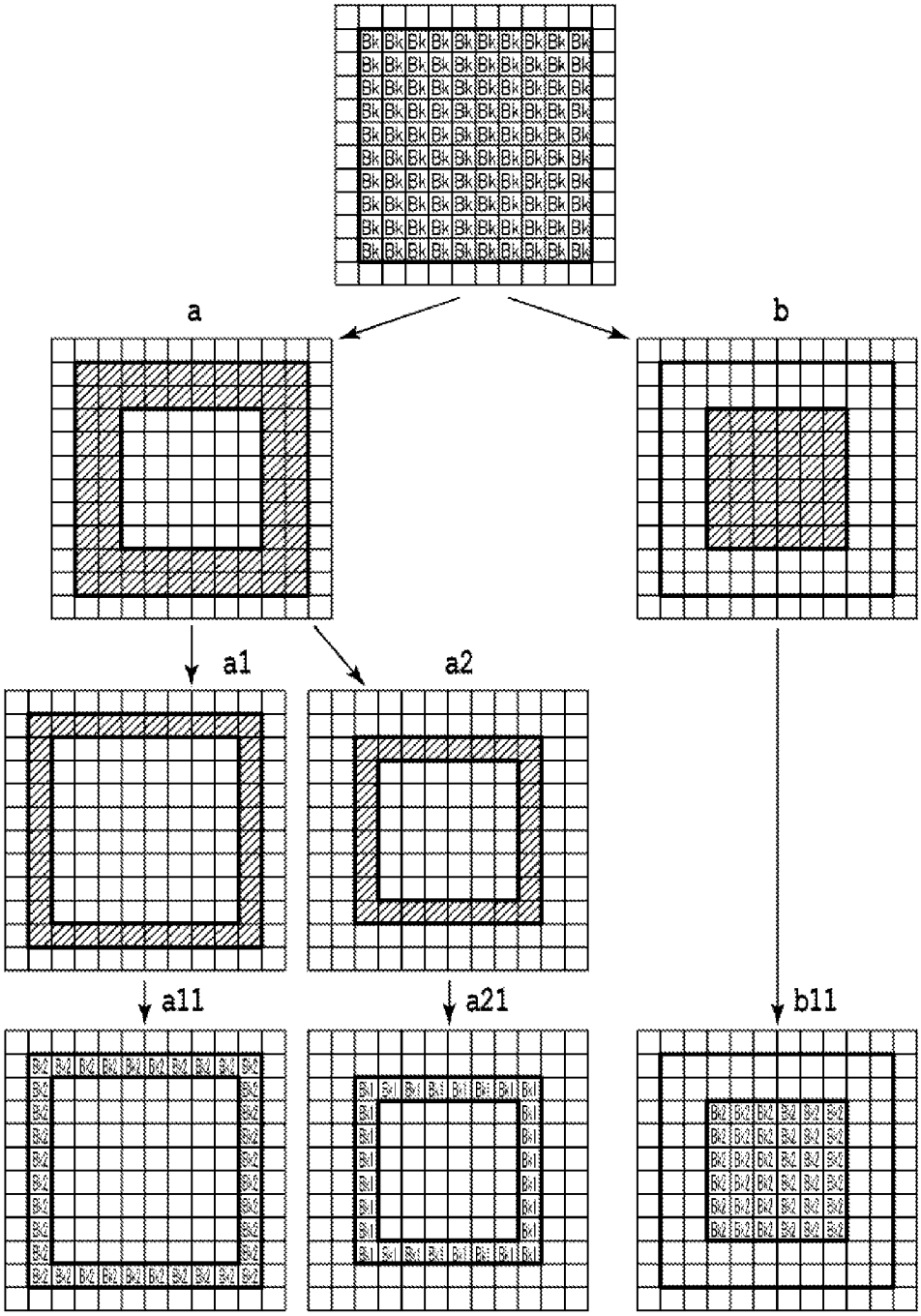
FIG. 12 is a schematic diagram showing an example of image processing on the non-absorption print medium.

An image is, as shown in FIG. 12, formed by using the characteristics. The original image is dissolved into a contour portion (edge portion) a, and a non-contour portion (inside region) b. Next, the contour portion a is dissolved into an outermost contour a1 and an inner contour a2. The outermost contour a1 corresponds to an image of a11, and the image a11 is formed by applying low surface tension inks 5*bk*2. The inner contour a2 corresponds to an image of a21, and the image a21 is formed by applying high surface tension inks 5*bk*1. b as the inside region corresponds to an image of b11, and the image b11 is formed by applying the low surface tension inks 5*bk*2.

FIGS. 13A, 13B, 13C and 13D are schematic diagrams for explaining inks ejected from the print head 5 at the time of ejecting the inks from the print head 5 mounted on the carriage 9 to cause the inks to land on a medium. First, in FIG. 13A, the carriage 9 moves in an arrow direction, and ink droplets are ejected from the print head 5. The ejection of the inks is performed such that the low permeable ink 5*bk*1 first lands on the medium, and next, the high permeable ink 5*bk*2 lands on the outer contour. Thereafter, an inside region of the image is sequentially formed by the high permeable ink 5*bk*2. Next, as shown in FIG. 13B, an image is sequentially formed in a direction opposite to that in FIG. 13A. At this time, as similar to the order shown in FIG. 13A, the ejection of the inks is performed such that the low permeable ink 5*bk*3 first lands on the medium and next, the high permeable ink 5*bk*2 lands thereon. FIG. 13C is a diagram in which inks land on the medium to complete the image formation. In FIG. 13D, the ink droplets positioned in the outer contour are pulled inside to move. At this time, the fixation is facilitated by an unillustrated fixing apparatus, and then the fixation is completed.

Since the low surface tension ink in the contour portion is pulled to the high surface tension ink in the inside of the image, a height at the edge of the boundary portion between a print medium surface and an ink surface is reduced. That is, a form at the end portion of the printed image formed by the ink becomes smooth. As a result, the robustness of the printed image improves. In addition, the ink in the contour portion is pulled to the inside, and thereby the bleeding in the contour of the boundary portion can be suppressed to form a clear image.

The present embodiment shows an example of printing the inside region by using the low surface tension ink, but also in a case of setting an ink to be applied onto the inside region to the high surface tension ink, a behavior of the ink on the edge portion does not change. As similar also in this case, the bleeding in the boundary portion can be suppressed to obtain a clear image. In addition, the value of the surface tension in the ink used in the present embodiment is shown as an example, and the present invention is not limited to this value.

In addition, in the present embodiment, an explanation is made of an example where the print medium having no ink receiving layer is used as a print medium, however, the present invention is not limited thereto. Even if the print medium has the ink receiving layer, since an absorption quantity of inks by the print medium is relatively small, the present invention may be applied also to a case where the ink remains on the surface of the print medium. Also in this case, the low surface tension ink and high surface tension ink remaining on the surface of the print medium are mixed and the low surface tension ink is pulled toward the high surface tension ink, thus making it possible to obtain a clear printed image with the bleeding suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-010044, filed Jan. 20, 2012, and 2012-279688, filed Dec. 21, 2012 which are hereby incorporated by reference herein in their entirety.

What is claimed is:

1. An image processing method for generating applying data for forming an image on a print medium by one or more relative scans between a print head for ejecting a first ink and a second ink, the second ink having the same color as the first ink and a lower surface tension than the first ink, and the print medium, the image processing method comprising the steps of:

generating first data for applying the first ink to a predetermined region adjacent to an edge region of the image and that is included in an inside region inward of the edge region, wherein the first data does not include data for applying the first ink to the edge region and the second ink to both of the predetermined region and the edge region;

generating second data for applying the second ink to the edge region, wherein the second data does not include data for applying the first ink to both of the predetermined region and the edge region and the second ink to the predetermined region; and generating third data for applying the first ink to the edge region, wherein the third data does not include data for applying the first ink to the predetermined region and the second ink to both of the predetermined region and the edge region, wherein the first ink is applied to the edge region based on the third data after the second ink is applied to the edge region based on the second data.

2. An image processing method according to claim 1, wherein the predetermined region is a whole of the inside region inward of the edge region.

3. An image processing method according to claim 1, wherein the third data is used for applying the first ink to the edge region after applying the second ink to the edge region during a single relative scan.

4. An image processing method according to claim 1, wherein a quantity of the second ink applied in the edge region is smaller than a quantity of the first ink applied in the edge region.

5. An image processing method according to claim 1, further comprising the step of:

generating fourth data for applying the second ink to the predetermined region on which the first ink is applied, wherein the fourth data does not include data for applying the first ink to both of the predetermined region and the edge region and the second ink to the edge region, wherein the second ink is applied to the predetermined region based on the fourth data after the first ink is applied to the predetermined region based on the first data.

6. An image processing method according to claim 5, wherein the fourth data is used for applying the second ink to the predetermined region after applying the first ink to the predetermined region during a single relative scan.

7. An image processing method according to claim 5, wherein a quantity of the first ink applied in the predetermined region is smaller than a quantity of the second ink applied in the predetermined region.

8. An image processing method according to claim 5, wherein in the print head, a first nozzle row and a third nozzle row, in which nozzles for ejecting the first ink are arrayed in a first direction, are arranged in a direction crossing the first direction, and a second nozzle row, in which nozzles for ejecting the second ink are arrayed, is arranged between the first nozzle row and the third nozzle row in the second direction.

9. An image processing method according to claim 8, wherein the print head is moved along the second direction from a side of the third nozzle row in the second direction to a side of the first nozzle row in the second direction, and the image processing method further comprising the steps of:

ejecting the first ink from the first nozzle row to the predetermined region based on the first data, ejecting the second ink from the second nozzle row to the predetermined region and the edge region based on the fourth data and the second data, and ejecting the first ink from the third nozzle row to the edge region based on the third data.

10. An image processing method according to claim 1, wherein the print medium includes a non-absorption print medium not provided with a receiving layer for receiving the ink.

11. The image processing apparatus according to claim 1, wherein the first ink and the second ink include a pigment as a color material.

12. An image processing method for generating applying data for forming an image on a print medium by one or more relative scans between a print head for ejecting a first ink and a second ink, the second ink having the same color as the first ink and a higher permeability into the print medium than the first ink, and the print medium, the image processing method comprising the steps of:

generating first data for applying the first ink to a predetermined region adjacent to an edge region of the image and that is included in an inside region inward of the edge region, wherein the first data does not include data for applying the first ink to the edge region and the second ink to both of the predetermined region and the edge region;

generating second data for applying the second ink to the edge region, wherein the second data does not include data for applying the first ink to both of the predetermined region and the edge region and the second ink to the predetermined region; and generating third data for applying the first ink to the edge region, wherein the third data does not include data for applying the first ink to the predetermined region and the second ink to both of the predetermined region and the edge region, wherein the first ink is applied to the edge region based on the third data after the second ink is applied to the edge region based on the second data.

13. An inkjet printing apparatus for printing an image on a print medium, comprising:

a print head for ejecting a first ink and a second ink, which has the same color as the first ink and a higher permeability into the print medium than the first ink;

a moving unit configured to relatively move the print head and the print medium; and a controller configured to control ejection of the first ink and the second ink such that (i) in a case of printing on a predetermined region that is adjacent to an edge region of the image and that is included in an inside region inward of the edge region, the first ink is ejected and the second ink is not ejected in advance of ejecting the first ink, and (ii) in a case of printing on the edge region, the second ink is ejected and then the first ink is ejected.

14. The inkjet printing apparatus according to claim 13, wherein the controller controls ejection of the first ink and the second ink such that in the case of printing on the predetermined region, the first ink is ejected and then the second ink is ejected.

15. The inkjet printing apparatus according to claim 14, wherein in the print head, a first nozzle row and a third nozzle row, in which nozzles for ejecting the first ink are arrayed in a first direction, are arranged in a direction crossing the first direction, and a second nozzle row, in which nozzles for ejecting the second ink are arrayed, is arranged between the first nozzle row and the third nozzle row in the second direction.

16. An inkjet printing apparatus for printing an image on a print medium, comprising:

a print head for ejecting a first ink and a second ink, which has the same color as the first ink and a lower surface tension than the first ink;

a moving unit configured to relatively move the print head and the print medium; and a controller configured to control ejection of the first ink and the second ink such that (i) in a case of printing on a predetermined region that is adjacent to an edge region of the image and that is included in an inside region inward of the edge region, the first ink is ejected and the second ink is not ejected in advance of ejecting the first ink, and (ii) in a case of printing on the edge region, the second ink is ejected and then the first ink is ejected.

17. The inkjet printing apparatus according to claim 16, wherein the controller controls ejection of the first ink and the second ink such that in the case of printing on the predetermined region, the first ink is ejected and then the second ink is ejected.

18. The inkjet printing apparatus according to claim 17, wherein in the print head, a first nozzle row and a third nozzle row, in which nozzles for ejecting the first ink are arrayed in a first direction, are arranged in a direction crossing the first direction, and a second nozzle row, in which nozzles for ejecting the second ink are arrayed, is arranged between the first nozzle row and the third nozzle row in the second direction.

19. An image processing method for generating applying data for forming an image on a print medium by one or more relative scans between a print head for ejecting a first ink and a second ink, the second ink having the same color as the first ink and a lower surface tension than the first ink, and the print medium, the image processing method comprising the steps of:

generating first data for applying the first ink to a predetermined region adjacent to an edge region of the image and that is included in an inside region inward of the edge region, wherein the first data does not include data for applying the first ink to the edge region and the second ink to both of the predetermined region and the edge region, and wherein the edge region corresponds to a boundary between a region in which the image is printed and a region in which the image is not printed; and generating second data for applying the second ink to the edge region, wherein the second data does not include data for applying the first ink to both of the predetermined region and the edge region and the second ink to the predetermined region.

* * * * *